US006100491A

United States Patent [19]

Moldovan

[11] Patent Number: 6,100,491

[45] Date of Patent: Aug. 8, 2000

[54] ELECTRIC CURRENT SWITCHING APPARATUS HAVING AN ARC EXTINGUISHER WITH AN ELECTROMAGNET

[75] Inventor: Peter K. Moldovan, Cascade, Wis.

[73] Assignee: Eaton Corporation, Cleveland, Ohio

[21] Appl. No.: 09/344,076

[22] Filed: Jun. 25, 1999

[51] Int. Cl.[7] ..... H01H 33/18

[52] U.S. Cl. ..... 218/38; 218/22; 218/149; 218/156; 335/201

[58] Field of Search ..... 218/22–40, 146, 218/149, 150, 151, 155–158, 1; 335/16, 147, 201, 202

[56] References Cited

U.S. PATENT DOCUMENTS

| | | | |
|---|---|---|---|
| 2,692,319 | 10/1954 | Dickinson et al. | 218/22 |
| 2,904,659 | 9/1959 | Boehne | 218/22 |
| 3,050,602 | 8/1962 | Korte et al. | 218/22 |
| 3,307,004 | 2/1967 | Bottonari | 218/34 X |
| 4,041,356 | 8/1977 | Buisson et al. | 218/38 X |
| 4,295,021 | 10/1981 | Ansinovsky et al. | 218/37 X |
| 4,918,268 | 4/1990 | Pothieux et al. | 218/26 |
| 5,616,898 | 4/1997 | Maineult | 218/76 |
| 5,763,847 | 6/1998 | Moldovan et al. | 218/38 |
| 5,866,864 | 2/1999 | Mody et al. | 218/38 |
| 5,877,464 | 3/1999 | Moldovan | 218/29 |

OTHER PUBLICATIONS

*Contactors Type BMS and BPS for Traction and Industry,* Sécheron, Feb. 18, 1998.

*Primary Examiner*—J. R. Scott

*Attorney, Agent, or Firm*—Quarles & Brady LLP; George E. Haas

[57] ABSTRACT

An electric switch has an arc extinguishing mechanism that includes a plurality of splitter plates located adjacent to the switch contacts. An electromagnet coil is connected between one of the contacts and a splitter plate to produce a magnetic field that drives an arc into the extinguishing mechanism. The unique electromagnet coil is formed by a lamination of a plurality of flat open loops of conductive material alternating with layers of insulation. The flat open loops are interconnected to form a helical coil.

12 Claims, 2 Drawing Sheets

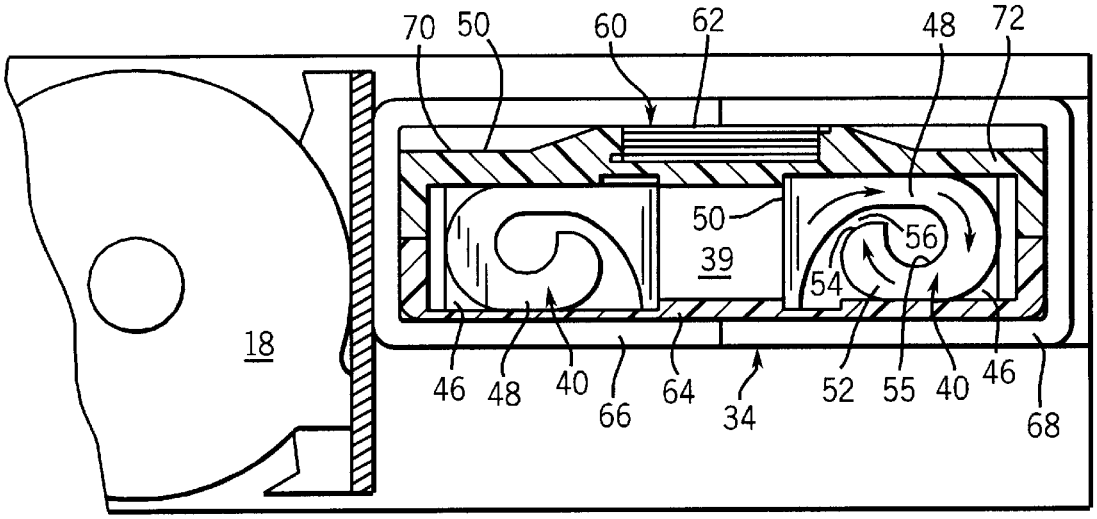
FIG. 2
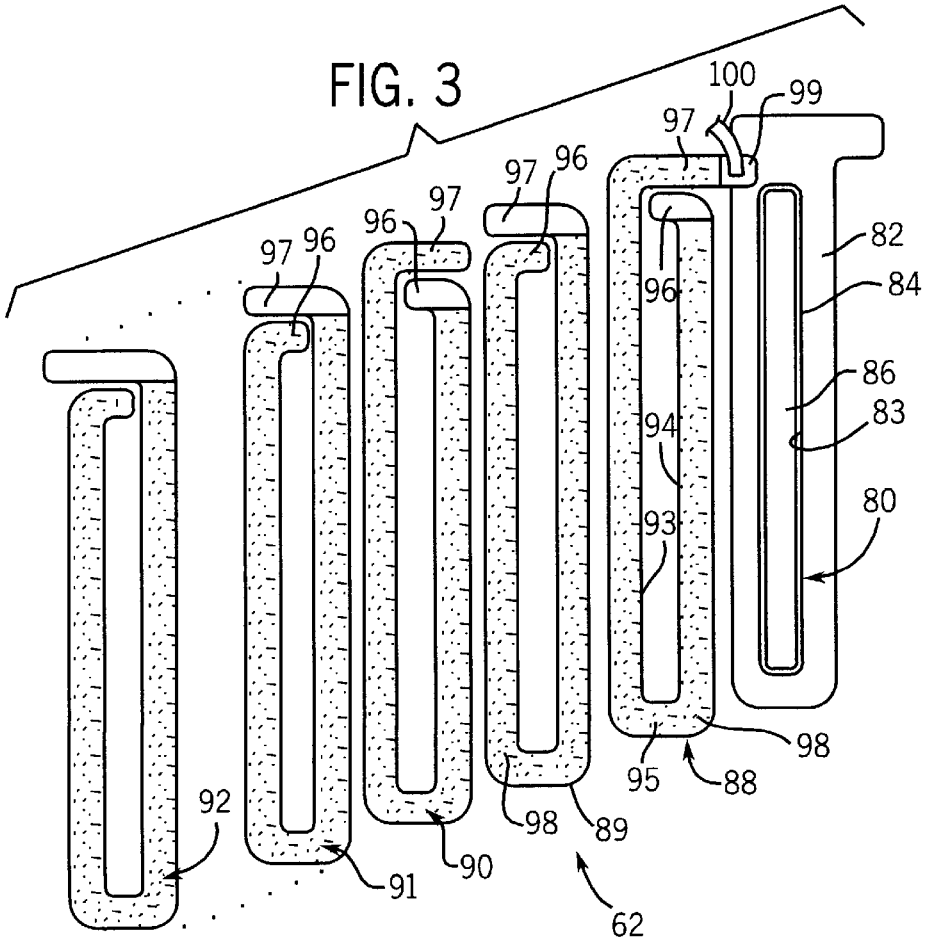

ELECTRIC CURRENT SWITCHING APPARATUS HAVING AN ARC EXTINGUISHER WITH AN ELECTROMAGNET

BACKGROUND OF THE INVENTION

This invention relates to apparatus for switching electric current, such as direct current (DC) electricity; and more particularly to such apparatus which has a mechanism for extinguishing arcs formed between switch contacts during separation.

DC electricity is used in a variety of applications such as battery powered systems, drives for motors and accessory circuits, in which contactors are used to make and break the flow of current to the load. Weight, reliability and high DC voltage switching and interrupting capability are important considerations in developing the contactor.

In many applications relatively large direct currents must be switched which produce arcs when the contacts of the contactor separate, thereby requiring a mechanism for extinguishing the arcs. Previous DC contactors and switches incorporated one or more arc extinguishing chambers, often referred to as "arc chutes" such as described in U.S. Pat. No. 5,866,864, to extinguish arcs that formed between the switch contacts. Arc extinguishing chambers comprise series of spaced apart electrically conductive splitter plates.

The self-magnetic field produced by current flowing through conductors in the contactor interacts with the arc creating a Lorentz force that drives the arc into the extinguishing chamber. In DC switching devices, permanent magnets on the sides of the series of splitter plates establish another magnetic field across the arc extinguishing chamber which directs the arc farther into the splitter plate arrangement. The arc then propagates from one splitter plate to another in the series and eventually spanning a number of gaps between the splitter plates whereby sufficient arc voltage is built up that the arc is extinguished.

The disadvantage of using permanent magnets is that the contactor is polarized whereby arc current flowing in only one direction produces a Lorentz force in a direction that drives the arc into the extinguishing chamber. The Lorentz force produced by arc current in the opposite direction inhibits the arc from moving farther into the second extinguishing chamber. A common contactor has a pair of stationary contacts and a moveable bridging contact with separate arc extinguishing chambers for each stationary contact. Therefore, the direction of the DC current determines which arc chamber of the two is active in a bidirectional contactor. However, it is desirable to provide arc extinction which is not dependent upon the direction of the arc current, thereby allowing both arc chambers to be simultaneously active and allowing the interruption of twice the magnitude of source voltage in a nonpolarized operating mode than that achievable in a permanent-magnet-based bidirectional contactor.

Some prior DC contactors employ an electromagnet to produce the magnetic field that drives the arc into arc horns with or without a splitter plate assembly. The DC current flowing through the contactor as the contacts separate also flows through the electromagnet. Thus with a direct current contactor, the electromagnet's magnetic field has a direction that interacts with the arc's current direction so that the Lorentz force always drives the arc into the extinguishing chamber.

However, contactors, that carry very large electric currents (e.g. 300–600 amps at 750–1500 volts) and have the electromagnet connected in-line with the main current carry path require a large (300 MCM gauge) conductor for the electromagnet coil. Some contactors connect the electromagnet to the arc runners which lead to a series of ferrous splitter plates. Thus, the electromagnet's conductors do not have to be excessively large as they carry current only during interruption of the arc. When the moveable contact separates from the stationary contact, an arc forms between the contacts. Through the self field of the current in the runner of the stationary contact, a Lorentz force is applied to the arc causing the arc to commutated to a pair of copper runners. As soon as the copper runners are electrically connected to the stationary contact, via the arc, the electromagnet, connected in series with one of the runners, provides a magnetic field transverse to the arc to drive the arc along the runners toward the splitter plate. While this method of electromagnet hook-up to the arc runners allows much smaller wire gauge for the electromagnet's conductors (typically 14–16 awg) the resulting bulky coil, due to its typical conventional round winding, still has a negative size impact on the contractor. Therefore the electromagnet adds significant volume to the size of the contactor. As with most devices, it is advantageous to minimize the size of the contactor.

SUMMARY OF THE INVENTION

The present invention provides a current switching apparatus that incorporates a mechanism to extinguish arcs which form when the switch contacts separate. In particular, a unique electromagnet is employed to create forces that drive the arc into the extinguishing mechanism.

That electric arc extinguishing mechanism comprises a plurality of splitter plates of electrically conductive material located adjacent to the pair of contacts to receive the electrical arc. An electromagnet coil is formed by a stack of alternating layers of open loops of substantially planar conductive material and electrically insulating material. The open loops are interconnected to form a wide, low profile, conductive helical coil which produces a magnetic field that interacts with the arc to drive the arc into a plurality of splitter plates.

In the preferred embodiment each open loop comprises first and second elongated members extending parallel to each other with a space there between. A first end member projects from a first end of the second elongated member toward and spaced from the first elongated member. A second end member extends from a first end of the second elongated member toward the first end of the second elongated member and is spaced therefrom. A cross member connects the second ends of the first and second elongated members. The insulating material preferably is coated onto the open loops.

This laminated structure forms a compact electromagnet coil which occupies minimal space and yet has relatively large current carrying capability.

BRIEF DESCRIPTION OF THE DRAWINGS

FIG. 2 is a cross-sectional view of the extinguishing chamber along line 2—2 in FIG. 1; and FIG. 3 is an exploded view of a novel laminated coil of the electromagnet.

DETAILED DESCRIPTION OF THE INVENTION

Figure 1:
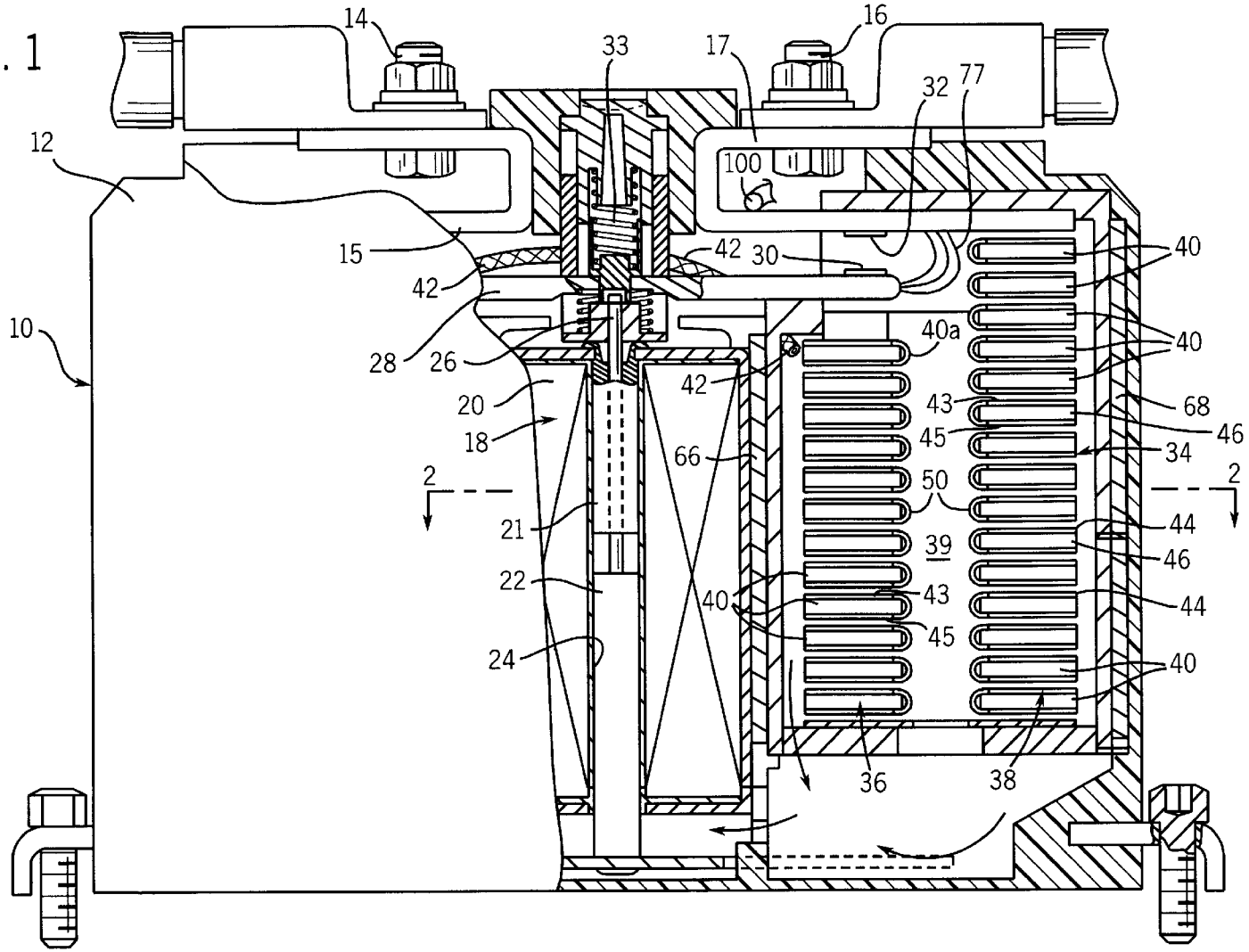
FIG. 1 is a cut away view of a DC contactor which incorporates an arc extinguishing chamber having an electromagnet according to the present invention.

With reference to FIG. 1, a sealed electromagnetic single pole contactor 10 has a plastic housing 12 with first and second power terminals 14 and 16. First power terminal 14 is connected to a first stationary contact 15, that is attached to the housing, and the second power terminal 16 is connected to a second stationary contact 17.

An electromagnetic solenoid 18 nests in recesses in the interior surfaces of the housing 12. The solenoid 18 has an annular coil 20, a core 21 and an armature 22 located within the central opening 24. The armature 22 includes a shaft 26 that passes through the core 21 and connects to a moveable contact arm 28, which in the closed state of the contactor bridges the stationary contacts 15 and 17 completing an electrical path between the power terminals 14 and 16. Each end of the moveable contact arm 28 has a contact pad 30 which in the closed state abuts a mating contact pad 32 on the stationary contact 15 or 17 associated with that end of the moveable contact arm. A spring assembly 33 biases the moveable contact arm 28 and the armature 22 so that the contactor 10 is in a normally open position when the solenoid coil 20 is de-energized, as illustrated in FIG. 1.

Each end of the moveable contact arm 28 extends into a separate arc extinguishing chamber. The two arc extinguishing chambers are mirror images of each other with one chamber 34 visible in FIG. 1. Arc extinguishing chamber 34 is formed by two stacks 36 and 38 of spaced apart splitter plates 40 with a region 39 between the stacks and may have a structure similar to that described in U.S. Pat. No. 5,866,864, the description of which is incorporated herein by reference. The top splitter plate in the inner stack 36 is connected by a wire braid 42 to the corresponding splitter plate in the other arc chamber beneath the first power terminal 14.

Referring to FIGS. 1 and 2, each splitter plate 40 has an outer U-shaped casing 44 with a pair of identical planar legs 43 and 45 connected by a curved edge 50. The curved edge 50 of each splitter plate 40 faces the center region 39 of the arc extinguishing chamber 34. The planar legs 43 and 45 of the splitter plates 40 are identical and have a curved shape resembling the mirror image of the Arabic numeral 9, in the orientation shown in FIG. 2. Specifically, each leg 43 and 45 has a distal section 48 projecting from one side of the curved edge 50 and tapering to one lateral side of the splitter plate 40. The distal section 48 transforms into a curved section 52 which bends back around toward itself terminating at an edge 54 which is spaced from the distal section 48 by a gap 56. The distal and curved sections 48 and 52 form an open loop with an inner diametric aperture 55.

The casing 44 of each splitter plate 40 is formed of an electrically conductive material, such as copper, and extends around a magnetic body 46 such as steel. This body 46 nests within the opening of the U-shaped casing 44 and has a rectangular shape with outer dimensions that correspond to those of the casing interior.

Because the contactor 10 switches direct current, a magnetic field is employed to move electric arcs into the arc extinguishing chamber 34. Referring to FIG. 2, that magnetic field is produced across center region 39 of arc extinguishing chamber 34 by an electromagnet assembly 60. This assembly comprises an electromagnet 62 located outside the plastic housing 64 along the height of arc extinguishing chamber 34 between the stacks 36 and 38 of splitter plates 40. The electromagnetic coils are mounted within the housing proximate to an arc chute and a stationary contact.

As shown in FIG. 3, the electromagnet 62 is formed by a lamination, or stack, of substantially flat copper loops with electrical insulating material there between, with the loops interconnected to form a helical coil. This unique design enables an wide, flat electromagnet coil to be placed in substantially the same volume that a conventional permanent magnet occupied in previous arc chutes. Because the coil is active only when the arc commutates to splitter plate 40 in outer stack 38, this coil can conduct electric currents up to several thousand amperes.

In this design, the electromagnet 62 includes a plastic bobbin 80 with a planar member 82 that has an elongated aperture 83 in the center and an annular wall 84 extending around the aperture on one side of the planar member. A steel core 86 fits within the aperture and annular wall 84. The loops of the coil of electromagnet 62 are formed by a plurality of flat turn segments cut from thin copper sheet stock and stacked onto the bobbin 80 with insulting layers between each turn segment. For example, there may be eighteen turn segments with five of them 88–92 being illustrated in FIG. 3, although other numbers of turn segments can be used to obtain the desired magnetic field strength.

The planar turn segments have an annular rectilinear shape similar to that of the bobbin 80. Each turn segment 88–92 has first and second substantially linear elongated members 93 and 94 parallel to each other on opposite sides of the annular wall 84 of the bobbin 82. A first end member 96 projects at a right angle from a first end of the second elongated member 94 toward the first elongated member 93, with a gap there between. A second end member 97 extends at a right angle from a first end of the first elongated member 93 parallel to and outside of the first end member 96 of the second elongated member 94 and is spaced therefrom. Adjacent second ends of the elongated members 93 and 94 are joined by a cross member 95. Therefore each turn segment 88–92 forms an overlapping electrically conductive open loop.

The electrically insulating layer is formed by a coating 98, indicated by stippling in FIG. 3, that is applied to selected areas on one major surface of each turn segment 88–92, as will be described. That insulating coating 98 prevents the facing portions of adjacent turn segments 88–92 from making electrical contact. Alternatively, appropriately shaped sheets of insulating material could be placed between the turn segments 88–92.

The second end member 97 of the first, or terminal, turn segment 88, which is placed against the bobbin 80, has a tab 99 projecting beyond the second elongated member 94 to enable electrical contact to be made to that end of the laminated electromagnet 62. Specifically a wire 100 is welded to that tab 99 and to the second stationary contact 17. The insulating coating 98 is applied over the major surface of the first turn segment 88 which faces away from the bobbin 82, except for the tab 99 and the first end member 96.

A series of identically shaped intermediate turn segments 89–91 then are stacked on top of the first turn segment 88 with their second end members 97 alternately pointing in opposite directions. This alternation results in the first major surface of a given turn segment facing the first major surface of one adjacent turn segment, and the second major surface of that given turn segment facing the second major surface of the other adjacent turn segment. In particular, the second turn segment 89 has its second end member 97 pointing in the opposite direction to that of the second end member 97 of the first turn segment 88. The first end member 96 of the second turn segment 89 is electrically connected, by welding or soldering for example, to the non-insulated first end member 96 of the first turn segment 88. Note that the insulating coating 98 applied on the remote surface of the second turn segment 89 covers the first end member 96, but not the second end member 97.

The third turn segment 90 is placed against the second turn segment 89 and their first end members 97 are electrically connected together. The insulating coating 98 on the remote surface of the third turn segment 90 covers the second end member 97, but not the first end member 96. The fourth turn segment 91 is identical to the second turn segment 89. The first end member 96 of the fourth turn segment 91 is electrically connected to the first end member 96 of the third turn segment 90. The next turn segment in the lamination is identical to the third turn segment 90. This alternating assembly of turn segments continues until the desired number of coil turns is provided.

Then a final turn segment 92 is placed onto the stack on the bobbin 82. This latter turn segment 92 is similar to the first turn segment 88, except that its second end member 97 with contact tab 99 projects in the opposite direction. A wire, not visible connects the contact tab 99 of the final turn segment 92 to the top splitter plate in the outer stack 38, in FIG. 1. The first end member 96 of the final turn segment 92 is electrically connected to the adjacent turn segment which is identical to the third turn segment 90. The interconnection of the turn segments 88–92 forms a helical electromagnet coil which is electrically connected between the second stationary contact and the top splitter plate in the outer stack 38.

With reference again to FIG. 2, the electromagnet 62 is magnetically coupled to a pair of U-shaped members 66 and 68 of ferrous material that abut the outside surface of this electromagnet and extend around opposite sides of the arc extinguishing chamber 34. The coupling of electromagnet 62 with U-shaped members 66 and 68 establishes a magnetic field across region 39 in the arc-extinguishing chamber 34 (vertically in FIG. 2), which directs electric arcs into the stacks of splitter plates 40, as will be described. A pair of plastic brackets 70 and 72 hold the splitter plates 40 in notches of the plastic housing 64 and close that housing.

With reference to FIG. 1, when the contactor 10 opens, the armature 22 and the attached contact arm 28 move away from the stationary contacts 15 and 17 which causes the contact pads 30 and 32 to separate and move into the position shown. As the contact pads 30 and 32 separate, an arc 77 may form there between. The Lorentz force produced by the interaction of the arc current with the self magnetic field produced by the electric current in the stationary contact 17 causes the arc 77 to move from contact pad 32 outward along the stationary contact 17 toward the outside stack 38 of splitter plates in arc extinguishing chamber 34. At the same time, the arc 77 moves off the other contact pad 30 onto the tip of the moveable contact arm 28.

The arc 77 propagates along the stationary contact 17 and onto the top splitter plate 40 in the outer stack 38. This results in electric current from the arc flowing from that top splitter plate through the electromagnet 62 to the second stationary contact 17. This current causes the electromagnet 62 to produce a magnetic field across the region 39 between the stacks 36 and 38 of splitter plates 40, i.e. into or out of the paper of FIG. 1, depending upon the direction of the electric current flow. Regardless of that current flow direction, the direction of the magnetic field will be such that interaction with the direction of the electric arc current creates a Lorentz force that causes the arc 77 to move downward in region 39 in the orientation of the contactor 10 in FIG. 1.

The arc 77 then bridges the vertical gaps between adjacent splitter plates 40 in the outer stack 38. Eventually the arc 77 travels down the outer stack 38 to the point where the other end of the arc travels onto the top splitter plate 40*a* in the inner stack 36. When the arc 77 attaches to the top plate 40*a* in the inner stack 36, two arc chambers are connected electrically in series making it possible to interrupt twice the source voltage of a conventional bidirectional contactor with permanent magnets.

Arc 77 continues propagating further downward onto each subsequent splitter plate 40 in stacks 36 and 38 of both arc chambers. This action forms separate sub-arcs in the vertical gaps between adjacent splitter plates 40. Eventually the arc 77 spans a sufficient number of gaps between the splitter plates of both arc extinguishing chambers, building up arc voltage larger than the source voltage and extinguishing the arc.

I claim:

1. An electric arc extinguishing mechanism for an electric current switch that has a pair of contacts, said electric arc extinguishing mechanism comprising:

a plurality of splitter plates, formed of electrically conductive material, located adjacent to the pair of contacts to receive an electrical arc that develops between pair of contacts; and and electromagnet coil mounted adjacent to the plurality of splitter plates to introduce a magnetic field in between the plurality of splitter plates, and comprising a stack of alternating layers of substantially planar open loops of conductive material and electrically insulating material, the open loops being interconnected to form a conductive helical coil, the electromagnetic coil produces a magnetic field that interacts with the arc to drive the arc through the plurality of splitter plates.

2. The electric arc extinguishing mechanism as recited in claim 1 wherein the electromagnet coil is electrically connected to one of the pair of contacts and to one of the plurality of splitter plates.

3. The electric arc extinguishing mechanism as recited in claim 1 wherein each open loop comprises:

first and second elongated members extending parallel to each other with a space there between, and each having first and second ends;

a first end member extending from the first end of the second elongated member toward the first elongated member and spaced therefrom;

a second end member extending from the first end of the second elongated member toward the first end of the second elongated member and spaced therefrom; and a cross member connected between the second ends of the first and second elongated members.

4. The electric arc extinguishing mechanism as recited in claim 3 wherein each open loop, that is stacked between two adjacent open loops, has the first end member connected to the first end member of one of the adjacent open loops, and the second end member connected to the second end member of the other one of the adjacent open loops.

5. The electric arc extinguishing mechanism as recited in claim 4 wherein each of the open loops has a first major surface and a second major surface; and each of the open loops, that is stacked between two adjacent open loops, has the first major surface facing the first major surface of one of the adjacent open loops, and the second major surface facing the second major surface of the other one of the adjacent open loops.

6. The electric arc extinguishing mechanism as recited in claim 1 wherein the electrically insulating material is a coating on the open loops.

7. The electric arc extinguishing mechanism as recited in claim 1 further comprising a core of ferrous material within the electromagnet coil.

8. An electric arc extinguishing mechanism for an electric current switch that has a pair of contacts, said electric arc extinguishing mechanism comprising:

a stack of a plurality of splitter plates formed of electrically conductive material, and located adjacent to the pair of contacts to receive an electrical arc that develops between pair of contacts; and and electromagnet coil mounted adjacent to the stack to introduce a magnetic field in between the plurality of splitter plates, and comprising a stack of a plurality of turn segments with a layer of electrically insulating material between adjacent ones of the plurality of turn segments, each of the plurality of turn segments comprising:

(a) first and second elongated members parallel to each other with a space there between, and each having first and second ends, (b) a first end member projecting from the first end of the second elongated member toward the first elongated member and spaced therefrom, (c) a second end member projecting from the first end of the second elongated member toward the first end of the second elongated member and spaced therefrom, and (d) a cross member connected between the second ends of the first and second elongated members; and wherein each turn segment, that is stacked between two adjacent turn segments, has the first end member connected to the first end member of one of the adjacent turn segments, and the second end member connected to the second end member of the other one of the adjacent turn segments.

9. The electric arc extinguishing mechanism as recited in claim 8 wherein the layer of electrically insulating material is a coating on at least some of the turn segments.

10. The electric arc extinguishing mechanism as recited in claim 8 wherein the electromagnet coil is electrically connected between one of the pair of contacts and one of the plurality of splitter plates.

11. The electric arc extinguishing mechanism as recited in claim 8 wherein each of the turn segments has a first major surface and a second major surface; and each of the turn segments, that is stacked between two adjacent turn segments, has the first major surface facing the first major surface of one of the adjacent turn segments, and has the second major surface facing the second major surface of the other one of the adjacent turn segments.

12. The electric arc extinguishing mechanism as recited in claim 8 further comprising a core of ferrous material within the electromagnet coil.

* * * * *